US005686932A

United States Patent [19]

Tomita

[11] Patent Number: 5,686,932

[45] Date of Patent: Nov. 11, 1997

[54] COMPENSATIVE DRIVING METHOD TYPE LIQUID CRYSTAL DISPLAY DEVICE

[75] Inventor: Satoru Tomita, Yokohama, Japan

[73] Assignee: Kabushiki Kaisha Toshiba, Kanagawa-Ken, Japan

[21] Appl. No.: 341,895

[22] Filed: Nov. 15, 1994

Related U.S. Application Data

[63] Continuation of Ser. No. 953,334, Sep. 30, 1992, abandoned.

[30] Foreign Application Priority Data

Oct. 4, 1991 [JP] Japan ..... 3-257687
Oct. 7, 1991 [JP] Japan ..... 3-259147

[51] Int. Cl.[6] ..... G09G 3/36

[52] U.S. Cl. ..... 345/94; 345/92

[58] Field of Search ..... 340/784, 811, 340/805; 345/92, 94, 95, 96, 208, 209, 210; 359/55, 57–59

[56] References Cited

U.S. PATENT DOCUMENTS

| | | | |
|---|---|---|---|
| 4,393,380 | 7/1983 | Hosokawa et al. | 359/57 |
| 4,928,095 | 5/1990 | Kawahara | 340/719 |
| 5,151,805 | 9/1992 | Takeda et al. | 359/57 |
| 5,194,974 | 3/1993 | Hamada et al. | 359/59 |

FOREIGN PATENT DOCUMENTS

| | | |
|---|---|---|
| 0 336 570 | 10/1989 | European Pat. Off. . |
| 0 373 565 | 6/1990 | European Pat. Off. . |
| 60-39620 | 8/1983 | Japan . |

OTHER PUBLICATIONS

A Compensative Driving Method to Common Electrode Voltage Distortions in TFT–LCDs, Tomita et al., ICICE Technical Report, vol. 91, No. 468, Feb. 14, 1992, pp. 29–34.

A Compensative Driving Method to Common Electrode Voltage Distortions in TFT–LCDs, Tomita et al., Conference Record of the 1991 International Display Research Conference, pp. 235–238.

*Primary Examiner*—Jeffery Brier
*Attorney, Agent, or Firm*—Finnegan, Henderson, Farabow, Garrett & Dunner, L.L.P.

[57] ABSTRACT

To compensate for voltage level shifts on the electrode of a liquid crystal display (LCD) pixel caused by parasitic capacitances between electrodes of a switching, thin film transistor (TFT) operating to apply image signal voltages to the LCD pixel electrode, a controlled voltage is applied to a storage capacitor connected in parallel with the LCD pixel to compensate for the voltage level shifts. As a result, an LCD image display, free of flicker and brightness nonuniformities, is achieved.

25 Claims, 11 Drawing Sheets

FIG. 8(a)
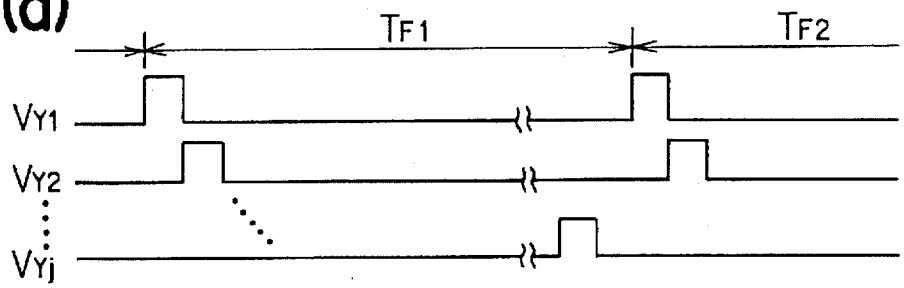
FIG. 8(b)
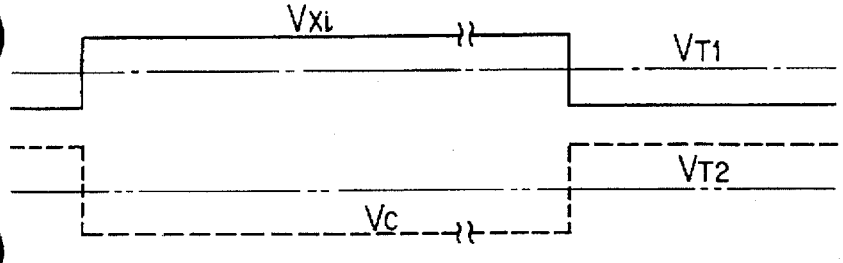
FIG. 8(c)
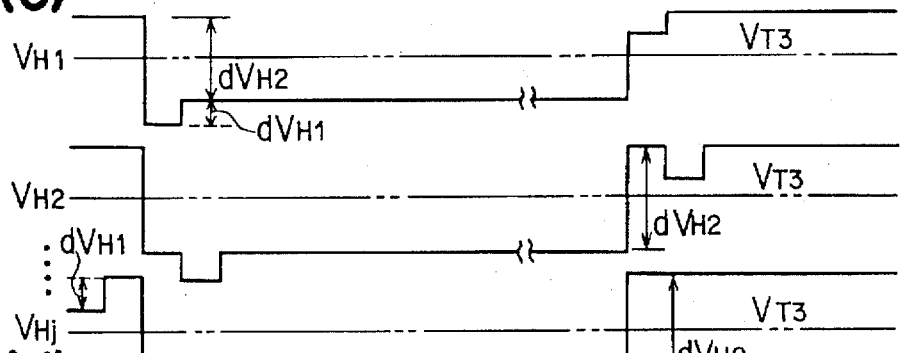
FIG. 8(d)
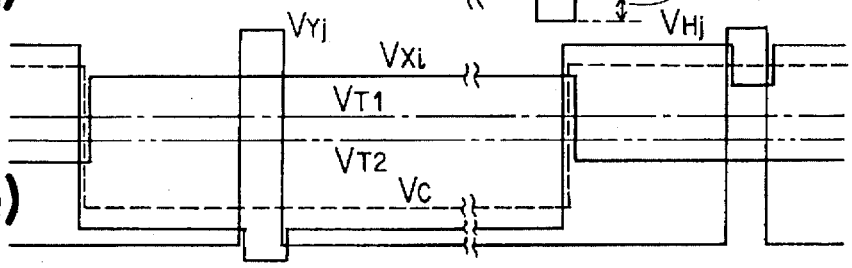
FIG. 8(e)
FIG. 8(f)
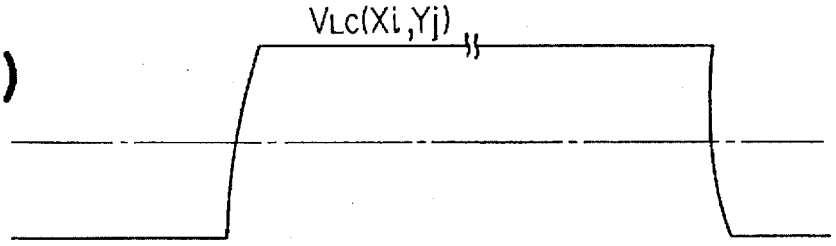

FIG.12(a)
(PRIOR ART)
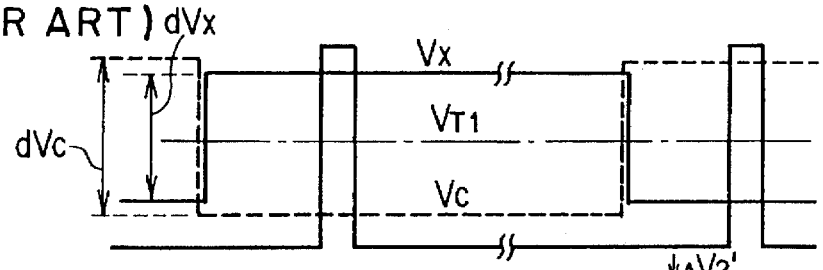
FIG.12(b)
(PRIOR ART)
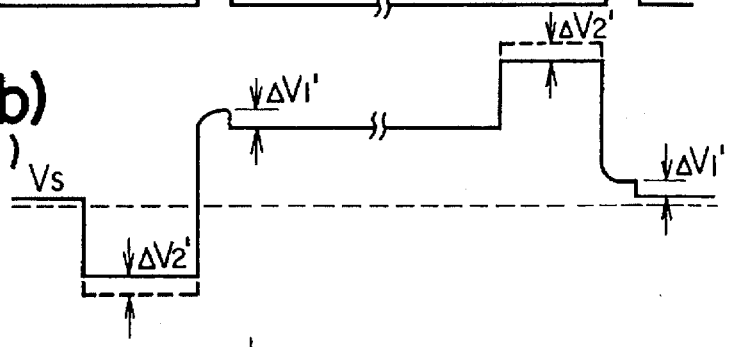
FIG.12(c)
(PRIOR ART)
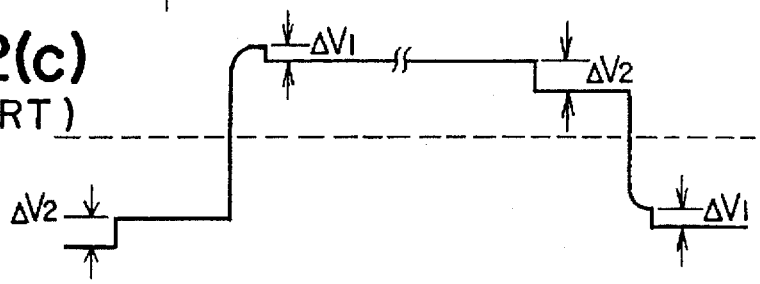
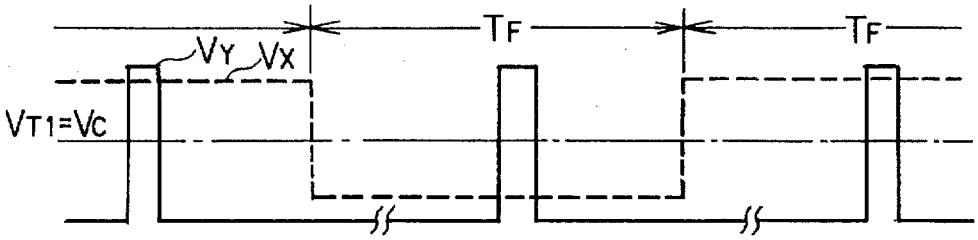
FIG. 12(d)
(PRIOR ART)

COMPENSATIVE DRIVING METHOD TYPE LIQUID CRYSTAL DISPLAY DEVICE

This application is a continuation of application Ser. No. 07/953,334, filed Sep. 30, 1992, now abandoned.

BACKGROUND OF THE INVENTION

1. Field of the Invention

The present invention relates to a liquid crystal display device and particularly to an active matrix type liquid crystal display device using a thin film transistor (TFT) as a switching element.

2. Description of the Related Art

Recently, liquid crystal display devices have been widely used as a display element for, e.g., a television and graphic display because of the thin size and low consumed electric power thereof.

Among them, an active matrix type liquid crystal display device using a thin film transistor (hereinafter referred to as TFT) as a switching element is suitable for a large number of pixels. The active matrix type liquid crystal display device is expected to realize high picture quality, large size and color image display. Thus, various investigations and developments therefor have been conducted and some have already practically been used.

A main part of a display element in the active matrix type liquid crystal display device is generally constructed of a switching active element such as a TFT; a pixel electrode connected with the active element; an active element array substrate arranged with the pixel electrode; a counter substrate formed on a counter electrode substrate thereon and arranged opposite to the array substrate; a liquid crystal composition held between these substrates; and polarizing plates adhered to the outer surfaces of these substrates.

FIG. 11 is a view illustrating a equivalent circuit of one pixel part of a conventional active matrix type liquid crystal display device.

An n type TFT switching element 605 is disposed in an intersection of a signal line 601 and scanning line 603. A drain electrode (D) 607 thereof is connected to the signal line 601, a gate electrode (G) 609 being connected to the scanning line 603, a source electrode (S) 611 being connected to a pixel electrode 613.

A liquid crystal composition 619 is held between the pixel electrode 613 and a counter electrode 617, which is connected to a counter electrode voltage generating circuit 615. In similar manner to the counter electrode 617, a storage capacitor (Cs) 623 is formed between a storage capacitor line 621, which is connected to the counter electrode voltage generating circuit 615, and the pixel electrode 613.

A counter electrode voltage (Vc), whose polarity is inverted with respect to a standard potential (VT1) is applied to the counter electrode 617 so as to be synchronized with an image signal voltage (Vc) reduces the amplitude of image signal voltage (VX), compared with the case of using a direct current voltage as a counter electrode voltage (Vc). However, as shown in FIG. 12(*d*), a direct current voltage may be used as the counter electrode voltage (Vc).

FIGS. 12(*a*), 12(*b*), 12(*c*) and 12(*d*) is a view illustrating each driving waveform of one pixel in the conventional active matrix liquid crystal display device shown in FIG. 11. Referring to FIGS. 12(*a*), 12(*b*), 12(*c*), and 12(*d*), an operation of the conventional active matrix liquid crystal display device will now be described.

As shown in FIG. 12(*a*), a scanning pulse (VY) is applied to the gate electrode (G) 609 of the TFT switching element 605 via the scanning line 603. The image signal voltage (VX), whose polarity is inverted against the standard potential (VT1) every frame period or every frame period as one period to prevent degradation of the liquid crystal composition 619, is applied to the signal line 601.

While the scanning pulse (VY) is applied to the gate electrode (G) 609 of the TFT switching element 605, the image signal voltage (VX) is written to the pixel electrode 613 and the pixel electrode 613 holds a pixel electrode potential (Vs) as shown in FIG. 12(*b*).

Thus, for frame period (TF), an electric potential difference between the pixel electrode potential (Vs) and counter electrode potential (Vc) is held in a liquid crystal capacitor (CLC), which has the liquid crystal composition 619 as a main part. As a result, the liquid crystal composition 619 is excited to execute display. On the other hand, an electric potential difference between the pixel electrode potential (Vs) and storage capacitor line potential, which is set up at the same potential as the counter electrode potential (Vc), is held in the storage capacitor (Cs) 623. As a result, time change of electric potential difference held in the liquid crystal capacitor (CLC), is compensated to keep the display for frame period (TF).

However, as shown in FIG. 11, there is a parasitic capacitance (CGS) associated with the gate electrode (G) 609 and the source electrode (S) 611 of the TFT switching element 605. This parasitic capacitance (CGS) of the TFT switching element 605 causes a level shift (ΔV1') shown in FIG. 12(*b*) in the pixel electrode potential (Vs) at the OFF timing of the scanning pulse (VY).

As shown in FIG. 11, there is a parasitic capacitance (CDS) associated with the drain electrode (D) 607 and the source electrode (S) 611 of the TFT switching element 605 and parasitic capacitance (CGS) associated with the source and gate electrodes. These parasitic capacitances (CDS), (CGS) cause a level shift (ΔV2') shown in FIG. 12(*b*) in the pixel electrode potential (Vs) at the polarity conversion of the image signal potential (Vy) and/or counter electrode potential (Vc).

As a result, in the conventional liquid crystal display device, as shown in FIG. 12(*c*), the level shifts (ΔV1), (ΔV2) occur in the liquid crystal applying voltage due to the parasitic capacities (CGS), (CDS). For these reasons, a voltage applied to the liquid crystal composition 619 is changed so that flickers or nonuniformity of brightness in a display image take place.

It is impossible to eliminate the parasitic capacitances (CGS) and (CDS).

As described above, the conventional liquid crystal display device has the problem that the level shifts (ΔV1), (ΔV2), caused by the parasitic capacitances (CGS), (CDS) of the TFT switching element 605, result in the occurrence of flickers or nonuniformity of brightness in a display image.

SUMMARY OF THE INVENTION

An object of the invention is to provide a liquid crystal display device with a stable high quality image display, without defects such as flickers or nonuniformity of brightness in a display image, which are caused by the level shifts (ΔV1), (ΔV2) of the liquid crystal applying voltage due to the parasitic capacitances (CGS), (CDS) of the TFT switching element.

The first aspect of this invention is a liquid crystal display device, comprising: a matrix wiring having a plurality of scanning lines and a plurality of signal lines, wherein a scanning pulse is applied to the scanning line and an image signal voltage, whose polarity is periodically inverted with respect to a first standard voltage, is applied to the signal line; a pixel electrode disposed in each intersection of the matrix wiring; a transistor switching element disposed in each intersection of the matrix and connected to each pixel electrode, each signal line and each scanning line; a storage capacitor line; and a storage capacitor formed between the storage capacitor line and the pixel electrode; a counter electrode disposed opposite to the pixel electrode; a liquid crystal composition held between the pixel electrode and the counter electrode; and means for applying a storage capacitor line voltage to the storage capacitor line, wherein the storage capacitor line voltage whose polarity is inverted with respect to a third standard potential applied to the storage capacitor line so as to compensate for a change of liquid crystal applying voltage caused by synchronizing with the image signal voltage.

The second aspect of this invention is a liquid crystal display device, comprising: a matrix wiring having a plurality of scanning lines and a plurality of signal lines, wherein a scanning pulse is applied to the scanning line and an image signal voltage, whose polarity is periodically inverted with respect to a first standard potential, is applied to the signal line; a pixel electrode disposed in each intersection of the matrix wiring; a transistor switching element disposed in an intersection of the matrix and connected to each pixel electrode, each signal line, and each scanning line; a counter electrode disposed opposite to the pixel electrode; a liquid crystal composition held between the pixel electrode and the counter electrode; a storage capacitor line and a storage capacitor formed between the storage capacitor line and the pixel electrode, the storage capacitor line being disposed substantially parallel to the scanning line; and storage capacitor line driving means for applying a storage capacitor line voltage to the storage capacitor line, wherein a potential of the storage capacitor line voltage changes to an opposite direction to that of the scanning pulse while synchronizing with the scanning pulse which is applied to the scanning line corresponding to the storage capacitor line.

The third aspect of this invention is a liquid crystal display device, comprising: a matrix wiring having a plurality of scanning lines and a plurality of signal lines, wherein a scanning pulse is applied to a scanning line, and an image signal, voltage whose polarity is periodically inverted with respect to a first standard potential, is applied to the signal line; a pixel electrode disposed in each intersection of the matrix wiring; a transistor switching element disposed in each intersection of the matrix and connected to each pixel electrode, each signal line and each scanning line; a counter electrode disposed opposite to the pixel electrode, wherein a direct current voltage of a second standard potential is applied to the counter electrode; a liquid crystal composition held between the pixel electrode and the counter electrode; a storage capacitor line, a storage capacitor being formed between the storage capacitor line and the pixel electrode, the storage capacitor line being disposed substantially parallel to the scanning line; and storage capacitor line driving means for applying a storage capacitor line voltage to the storage capacitor line, wherein the storage capacitor line voltage whose polarity is inverted with respect to a third standard potential is applied to the storage capacitor line so as to compensate for a change of a liquid crystal applying voltage by synchronizing with the image signal voltage, and a potential of the storage capacitor line voltage changes in an opposite direction to that of the scanning pulse while synchronizing with the scanning pulse to be applied to the scanning line corresponding to the storage capacitor line.

The fourth aspect of this invention is a liquid crystal display device, comprising: a matrix wiring having a plurality of scanning lines and a plurality of signal lines, wherein the scanning pulse is applied to the scanning line and an image signal voltage, whose polarity is periodically inverted with respect to a first standard potential, is applied to the signal line; a pixel electrode disposed in each intersection of the matrix wiring; a transistor switching element disposed in each intersection of the matrix and connected to each pixel electrode, each signal line and each scanning line; a counter electrode disposed opposite to the pixel electrode, wherein a counter voltage, whose polarity is inverted with respect to a second standard potential while synchronizing with an image signal voltage, is applied to the counter electrode; a liquid crystal composition held between the pixel electrode and the counter electrode; a storage capacitor line, and a storage capacitor formed between the storage capacitor line and the pixel electrode, the storage capacitor line being disposed substantially parallel to the scanning line; and storage capacitor line driving means for applying a storage capacitor line wherein voltage to the storage capacitor line, the storage capacitor line voltage has an amplitude whose polarity is the same as the polarity of the counter voltage with respect to a third standard potential and the potential of the storage capacitor line voltage changes in direction opposite to the scanning pulse substantially to synchronize with the scanning pulse to be applied to the scanning line corresponding to the storage capacitor line.

There are the parasitic capacitances (CDS), (CGS) of the TFT switching element in an active matrix type liquid crystal display device. When the polarity of the image signal voltage (VX) and/or counter electrode voltage (Vc) are inverted with respect to the standard potential, the potential at the drain electrode (D) side of the parasitic capacitance (CDS) is largely changed. As a result, electric charge is re-distributed between the liquid crystal capacitor (CLC), storage capacitor (Cs), and parasitic capacities (CGS), (CDS). In the conventional liquid crystal device, this change causes the level shift ($\Delta V2$) in the liquid crystal applying voltage.

According to the invention, a storage capacitor line is positively driven to let such a level shift ($\Delta V2$) to disappear.

Namely, in the liquid crystal display device according to the invention, the storage capacitor line voltage (VH), whose polarity is inverted with respect to the second standard potential to synchronize with the image signal voltage (VX) to compensate for a change of the liquid crystal applying voltage, is applied to the storage capacitor line. As a result, the level shift ($\Delta V2$) of the liquid crystal applying voltage caused by re-distribution of the electric charge can be reduced, and further can be disappeared.

Further, in this case, preferably, if the amplitude (dVH) of the storage capacitor line voltage (VH) is controlled .to be in the range of $|-CDS.dVX/Cs|/5$ or more but $|-CDS.dVX/Cs|\times 10$ or less, specially $|-CDS.dVX/Cs|$, the level shift ($\Delta V2$) is effectively compensated without shortage or excess to prevent flickers or nonuniformity of brightness in a display image, thereby obtaining a stable image display with a high quality.

In a liquid crystal display device where the polarity of the voltage (Vc) to be applied to the counter electrode is inverted with respect to the second standard potential, the storage capacitor line voltage (VH), whose polarity is inverted with respect to the third standard potential synchronize with the polarity conversion of the image signal voltage (VX) with respect to the first standard potential to be the same as that of the counter electrode voltage (Vc), is applied to the storage capacitor line. As a result, the level shift (ΔV2) of the liquid crystal applying voltage caused by re-distribution of the electric charge can be suppressed. This reduces change of the voltage of the liquid crystal applying voltage, and further can let the change to disappear.

Further, in this case, preferably, if the amplitude (dVH) of the storage capacitor line voltage (VH) is controlled to be in the range of |[(CGS+CDS+Cs).dVc-CDS.dVX]/Cs|/5 or more but |[(CGS+CDS+Cs).dVc-CDS.dVX]/Cs|×10 or less, specially |[(CGS+CDS+Cs).dVc-CDS.dVX]/Cs|, the level shift (ΔV2) is most effectively compensated to prevent flickers or nonuniformity of brightness in a display image, thereby obtaining a stable image display with a high quality.

With respect to the level shift (ΔV1), the storage capacitor line voltage (VH), which is changed in direction opposite to the scanning pulse (VY) substantially to synchronize with a scanning pulse (VY) by an amount of a voltage change dVH1, is applied to the storage capacitor line to synchronize with a timing of applying the scanning pulse (VY). The storage capacitor line corresponds to the pixel electrode connected to the TFT switching element to which the scanning pulse (VY) is to be applied. As a result, electric potential differences of the liquid crystal capacitor and storage capacitor changed by the parasitic capacitance (CGS) are compensated to suppress the level shift (ΔV1) of the liquid crystal applying voltage. This prevents flickers or nonuniformity of brightness in a display image. If dVH1 is in the range of |-CGS.dVY/Cs|/2 or more but |-CGS.dVY/Cs|×2 or less, specially |-CGS.dVY/Cs|, the level shift (ΔV1) can be most effectively suppressed.

As is apparent from the above equation of the amplitude (dVH) of the storage capacitor line voltage (VH), if the storage capacitor (Cs) is set larger, the amplitude (dVH) becomes smaller. The structure of a circuit, which supplies a storage capacitor line voltage, can be simplified. The storage capacitor (Cs) is set up at a large value in, for example, the following three manners: First, a storage capacitor line is formed of a transparent electrode such as ITO (indium oxide.tin) and an overlap area with a pixel electrode is enlarged without decrease of the aperture ratio, thereby increasing the area of the storage capacitor (Cs) and then the capacity value thereof. Second, a dielectric with a high dielectric constant is used as a material of an insulating film which is inserted between the storage capacitor line and pixel electrode, thereby increasing the capacity value. Third, the insulating film between the storage capacitor line and pixel electrode is formed such that the thickness of the insulating film is thin, thereby increasing the capacity value.

BRIEF DESCRIPTION OF THE DRAWINGS

FIGS. 8(*a*), 8(*b*), 8(*c*), 8(*d*), 8(*e*), and 8(*f*) is a view illustrating driving waveforms of an active matrix type liquid crystal display device according to a third embodiment of the present invention.

FIGS. 12(*a*), 12(*b*), 12(*c*), and 12(*d*) is a view illustrating driving waveforms of a conventional liquid crystal display device.

DESCRIPTION OF THE PREFERRED EMBODIMENTS

Referring to the accompanying drawings, one embodiment of this invention will now be described in detail.

Figure 1:
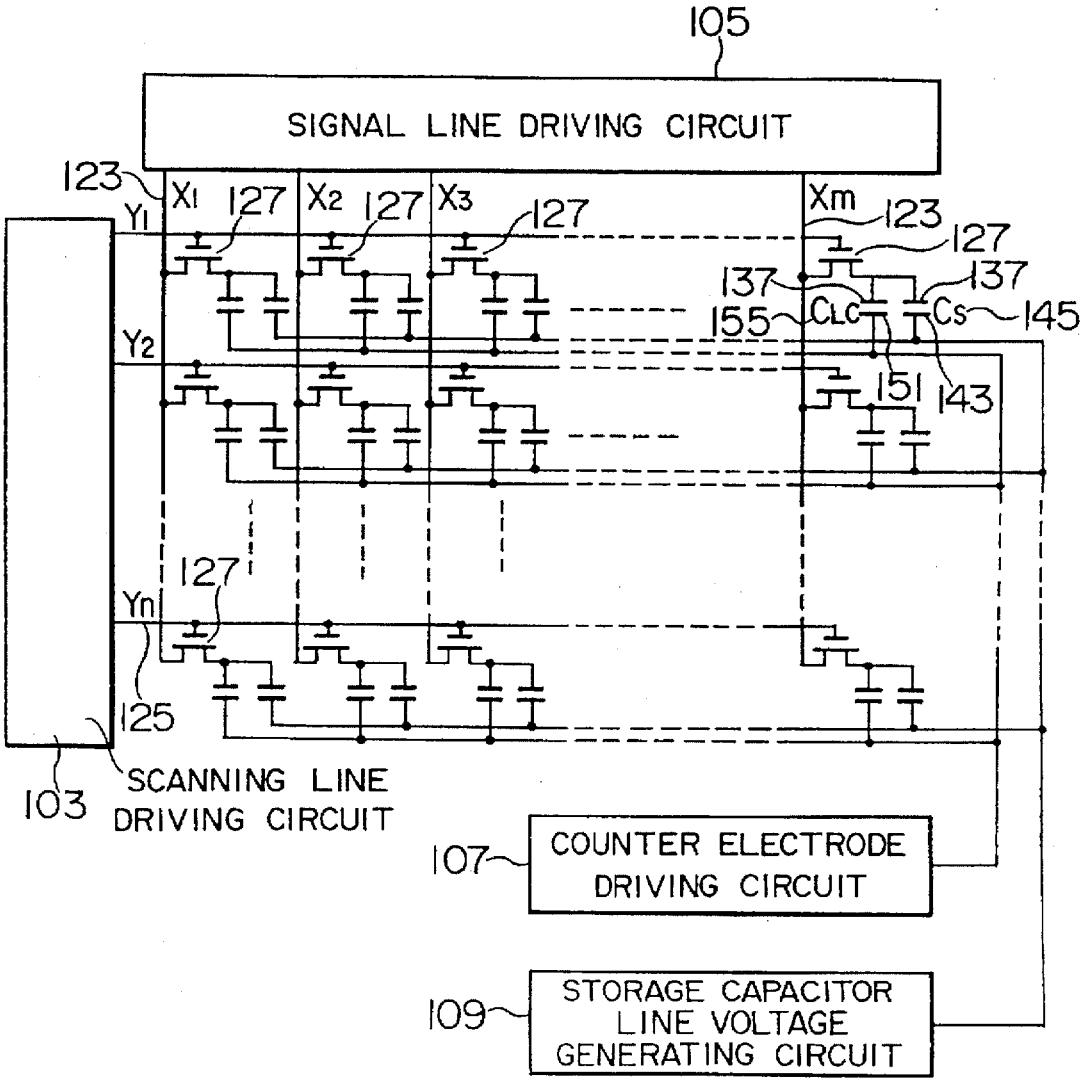
FIG. 1 is a view illustrating the structure of an active matrix type liquid crystal display device according to a first embodiment of the present invention.
Figure 2:
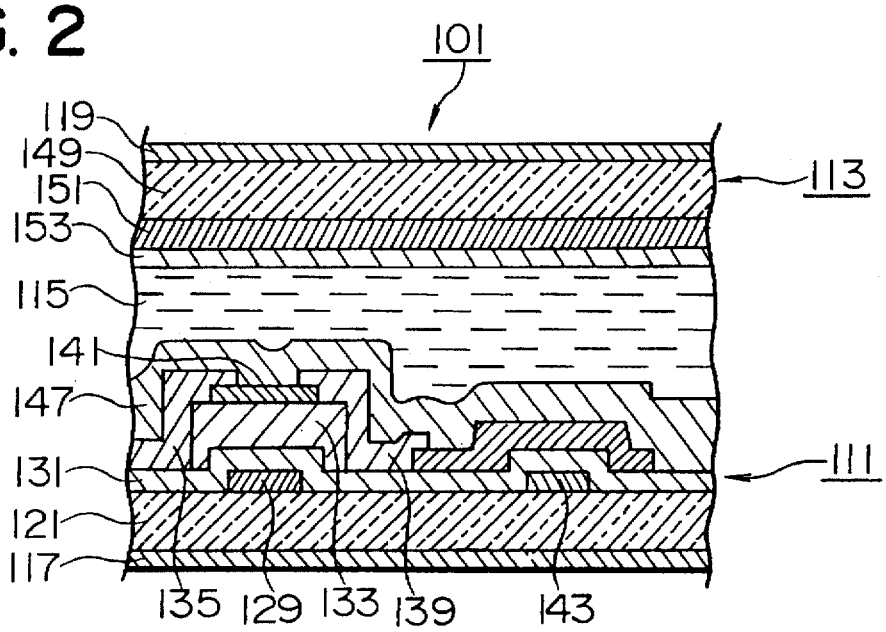
FIG. 2 is a view illustrating the structure of an active matrix type liquid crystal display device according to the first embodiment of the present invention.

FIG. 1 is a schematic view illustrating the structure of an active matrix type liquid crystal display device according to this invention. FIG. 2 is a sectional view of a liquid crystal display element used therefor.

The main part of the active matrix type liquid crystal display device is constructed of a liquid crystal display element 101, a scanning line driving circuit 103, a signal line driving circuit 105, a counter electrode driving circuit 107, and a storage capacitor line voltage generating circuit 109.

The liquid crystal display element 101 holds a liquid crystal composition 115 between an active element substrate 111 and a counter substrate 113. A polarizing plate 117 is arranged on the active element substrate 111 and a polarizing plate 119 is arranged on the counter substrate 113.

In the active element substrate 111, m signal lines 123 and n scanning lines 125 are arranged on a transparent insulating substrate 121 using a glass substrate in a matrix form. In each intersection, there is arranged a TFT element 127 as a switching element. As the transparent insulating substrate 121, a plastic film besides a glass substrate may be used.

In the TFT element 127, an insulating film 131 is placed on a gate electrode 129, which is formed integrately with the scanning line 125, so as to cover the gate electrode 129. An active layer 133, which is formed of n type amorphous silicon (a-Si), is placed thereon. A drain electrode 135, which is formed integrately with the signal line 123, and a source electrode 139, which is connected to a pixel electrode 137 formed of ITO are connected to the active layer 133, via an ohmic contact layer (not shown). The TFT element 127 is constructed such that a channel protect film 141 as an etching stopper is placed on the active layer 133 to prevent the active layer 133 from damage during a production process.

Further, a storage capacitor line 143, which is formed of a Mo-Ta alloy and produced in the same step of the scanning line 125, is placed on the transparent insulating substrate 121. In the plane-arrangement, the storage capacitor line 143 is substantially parallel to the scanning line 125. In the layer-arrangement, the storage capacitor line 143 faces the pixel electrode 137 through the insulating film 131. A storage capacitor (Cs) 145 is formed between the storage capacitor line 143 and pixel electrode 137. The storage capacitor (Cs) 145 uses the insulating layer 131 as a dielectric.

An active element substrate 111 is constructed such that an orientation film 147 covers the upper surface of the active element substrate 111.

The counter substrate 113 is constructed such that a counter electrode 151 and orientation film 153, which are opposite to the pixel electrode 137, are placed on a transparent insulating substrate 149 of a glass substrate. The counter substrate 113 is combined with the active element substrate 111 in parallel therewith in a predetermined space. This counter electrode 151 is connected to the counter electrode driving circuit 107, which generates a direct current voltage (Vc).

The liquid crystal composition 115 is held between the active element substrate 111 and counter substrate 113. The periphery thereof is sealed with a sealing material (not shown). The polarizing plates 117, 119 are placed and adhered to outer surfaces of the active element substrate 111 and counter substrate 113, respectively.

In such a liquid crystal display device 101, the signal line 123 is connected to the signal line driving circuit 105, the scanning line 125 is connected to the scanning driving circuit 103, each storage capacitor line 143 is connected in common to the storage capacitor line voltage generating circuit 109, and the counter electrode 151 is connected to the counter electrode driving circuit 107.

The main part of the signal line driving circuit 105 is constructed as a shift register circuit and a latch circuit. As shown in FIG. 4(*b*), the signal line driving circuit 105 generates an image signal voltage (VX), whose polarity is inverted against a first standard potential (VT1) every one frame period (TF) as one period, and provides it to the signal line 123.

The main part of the scanning line driving circuit 103 is constructed as a shift register circuit and latch circuit. The scanning line driving circuit 103 generates a scanning pulse (VY), as shown in FIG. 4(*a*), which selects each scanning line 125 one-at-a-time, and provide it to the scanning lines 125.

Figure 5:
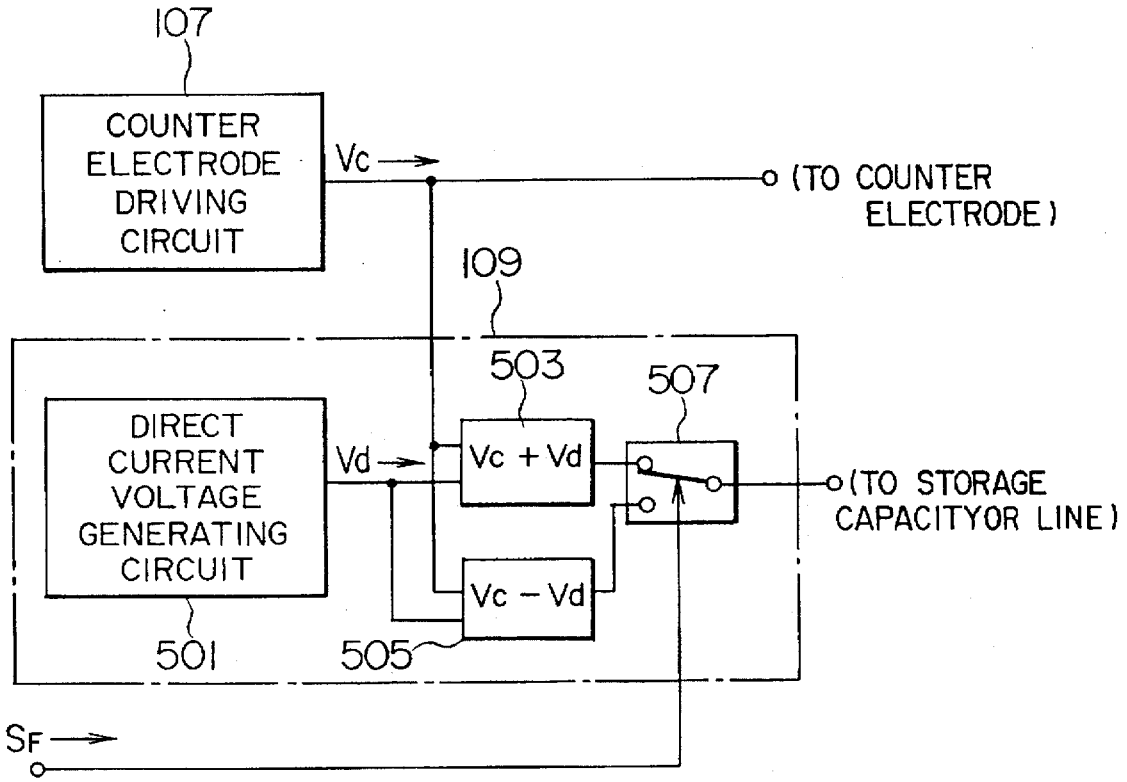
FIG. 5 is a view illustrating the structure of a storage capacitor line voltage generating circuit of an active matrix type liquid crystal display device according to the first embodiment of the present invention.
Figure 6A:
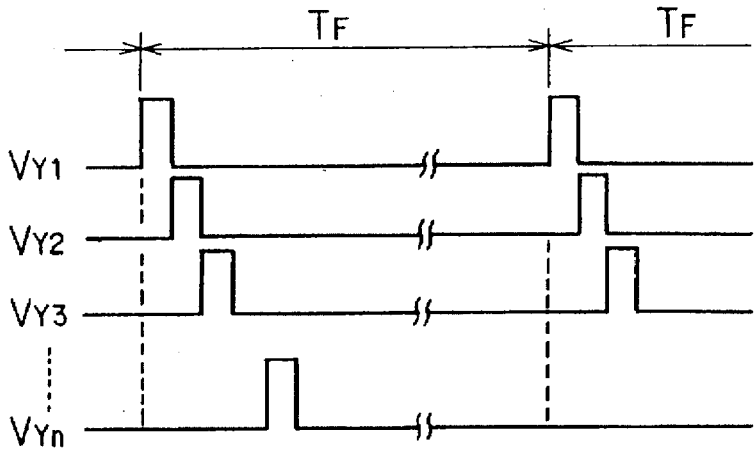
FIGS. 6(*a*), 6(*b*), 6(*c*), 6(*d*), 6(*e*), and 6(*f*) is a view illustrating driving waveforms of an active matrix type liquid crystal display device according to a second embodiment of the present invention.
Figure 6B:
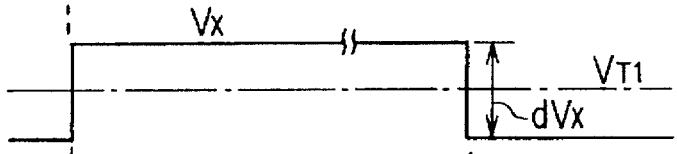
Figure 6C:
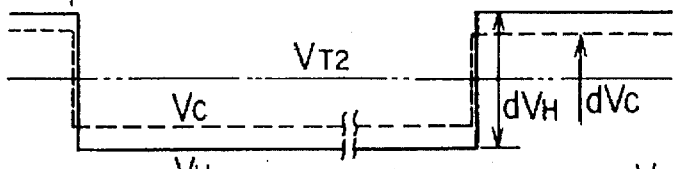
Figure 6D:
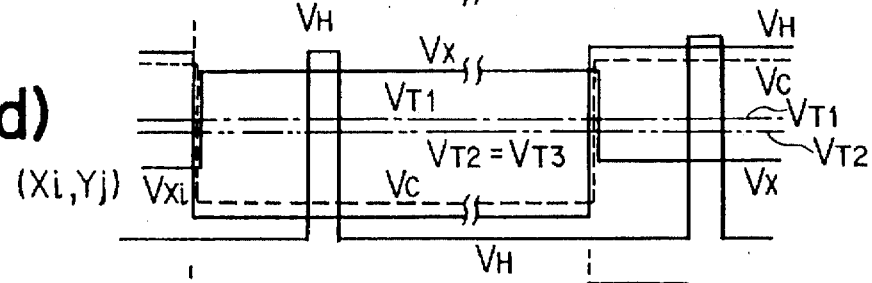
Figure 6E:
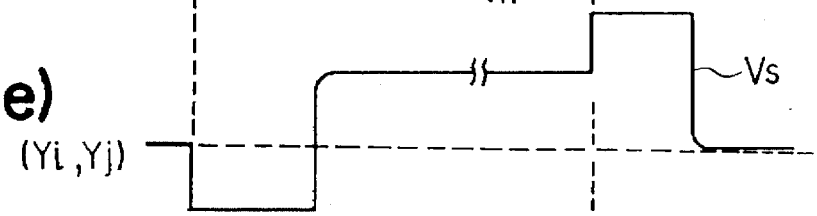
Figure 6F:
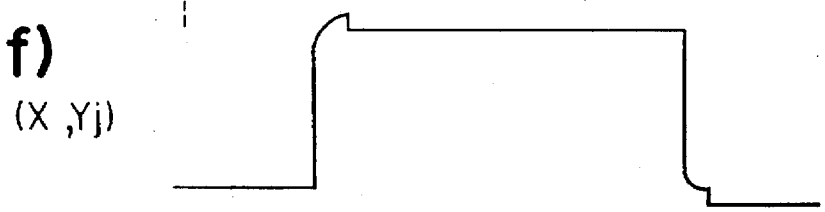

The main part of the storage capacitor line voltage generating circuit 109 is, as shown in FIG. 5, constructed of an addition circuit 503, a subtraction circuit 505 and a switching circuit 507. The addition circuit 503 adds the counter electrode voltage (Vc) of a direct current supplied by the counter electrode driving circuit 107 with a voltage (Vd) supplied by a direct current voltage generating circuit 501, and outputs the sum. The subtraction circuit 505 subtracts the voltage (Vd) supplied by the direct current voltage generating circuit 501 from the direct current voltage (Vc) supplied by the counter electrode driving circuit 107, and outputs the result. The switching circuit 507 selects the output from the addition circuit 503 or the output from the substraction circuit 505 in accordance with a frame signal (SF) every frame period (TF). As described above, inside the storage capacitor line voltage generating circuit 109, the added output of the direct current counter electrode voltage (Vc) and the above voltage (Vd), or the subtracted output thereof is selected alternately to apply a storage capacitor line voltage (VH) with an amplitude (dVH) to the storage capacitor line 143.

Figure 3:
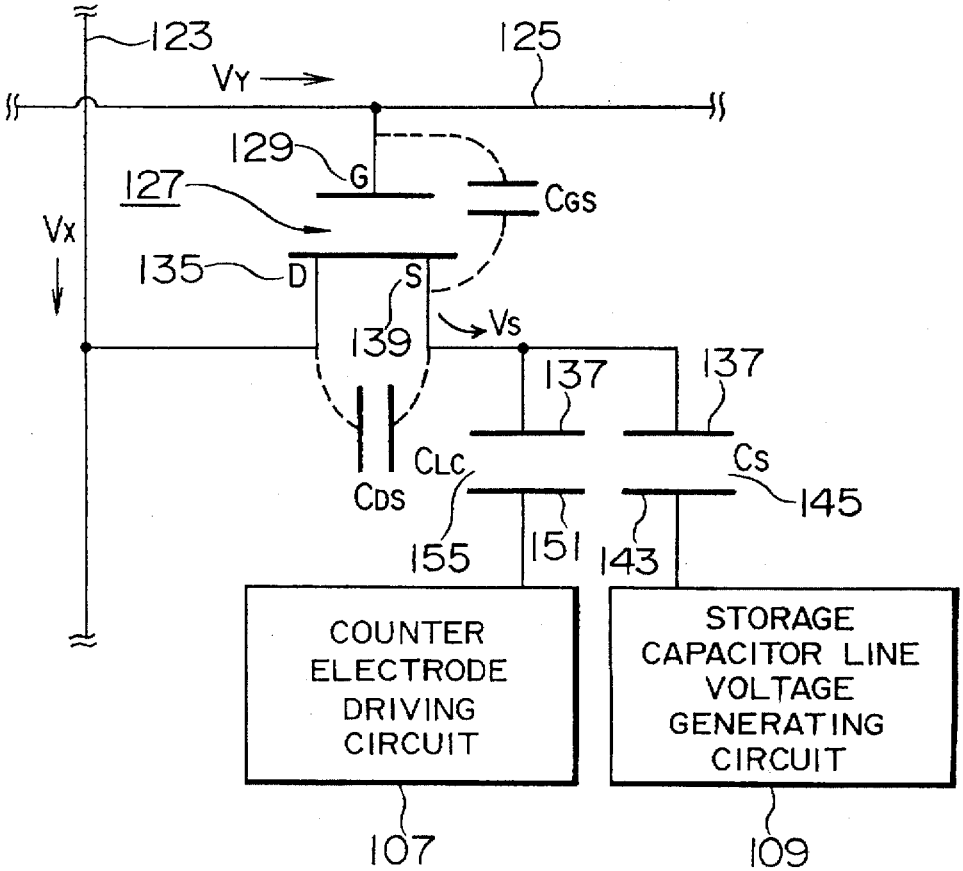
FIG. 3 is a view illustrating an equivalent circuit showing the structure of an active matrix type liquid crystal display device according to the present invention.
Figure 4A:
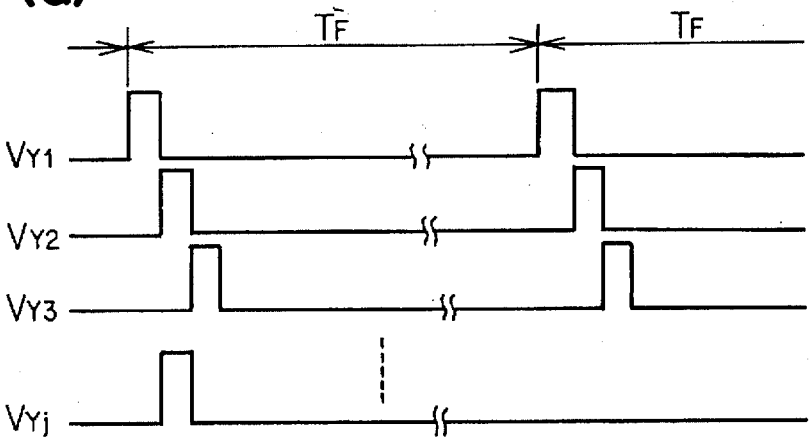
FIGS. 4(*a*), 4(*b*), 4(*c*), 4(*d*), 4(*e*) is a view illustrating driving waveforms of an active matrix type liquid crystal display device according to the present invention.
Figure 4B:
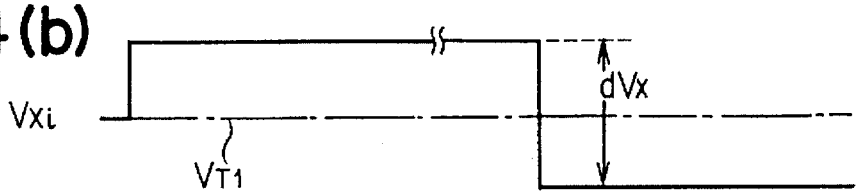
Figure 4C:
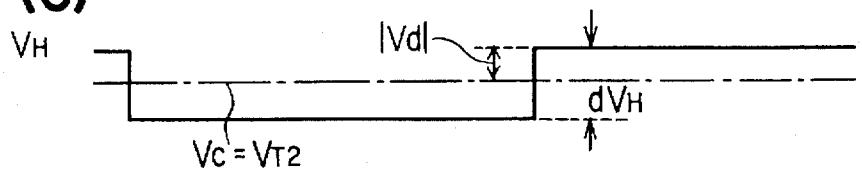
Figure 4D:
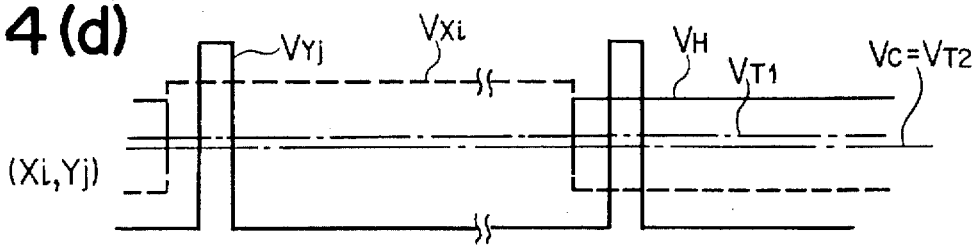
Figure 4E:
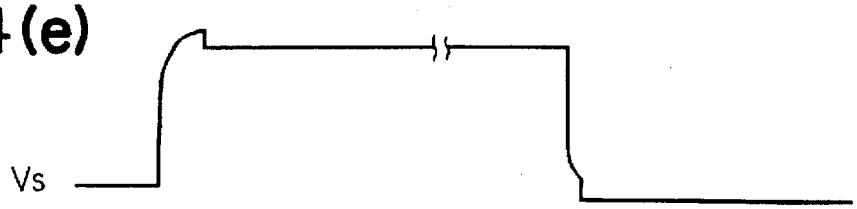

Referring to FIGS. 3 and 4(*a*), 4(*b*), 4(*c*), 4(*d*), and 4(*e*), operation of the active matrix type liquid crystal display device of the embodiment thus constructed will be described.

FIG. 3 is a view illustrating the equivalent circuit of one pixel part of the active matrix type liquid crystal display device. For example, a pixel, i.e., a display pixel (Xi, Yj) which exists in the intersection of the signal line 123 and scanning line 125 will be described. As shown in FIG. 4(*d*), if an image signal voltage (VXi) is applied to the drain electrode 135 and a scanning pulse (VYj) is applied to the gate electrode 129, a drain/source current (IDS) flows between the drain electrode 135 and source electrode 139. Then, the image signal voltage (VXi) is written in the pixel electrode 137 connected to the source electrode 139. A pixel electrode potential (Vs), as shown in FIG. 4(*e*), is held in the pixel electrode 137. Thus, for each frame period (TF), the electric potential difference between the pixel electrode potential (Vs) and counter electrode potential (Vc) is held in a liquid crystal capacitor (CLC) 155, thereby exciting the liquid crystal composition 115 to effect display. Electric potential difference between the pixel electrode potential (Vs) and storage capacitor line potential (VH) is held in the storage capacitor (Cs) 145. The reduction of electric potential difference in the liquid crystal capacitor (CLC) 155 as time elapses is compensated to maintain a display for one frame period (TF).

Furthermore, as shown in FIG. 3, in the n type TFT element 127, there inherently exists a parasitic capacitance (CGS) between the gate electrode 129 and source electrode 139, and another parasitic capacitance (CDS) between the drain electrode 135 and source electrode 139, due to the structure of the TFT element 127, and the arrangement of the pixel electrode 137 and signal line 123. Thus, even if the TFT element 127 is turned off (high resistant state), an electric potential difference, which is held in the liquid crystal capacitor (CLC) 155 and storage capacitor (Cs) 145, is changed by the potential change of the signal line via the parasitic capacitances (CDS), (CGS). As a result, the potential of the pixel electrode 137, and the liquid crystal applying voltage are changed. In the conventional liquid crystal display device, this causes level shift (ΔV2) seen in FIGS. 12(*b*) and 12(*c*).

According to the liquid crystal display device of the present invention, a storage capacitor line voltage (VH) corresponding to the level shift (ΔV2) is applied to the storage capacitor line 143. As a result, the electric potential difference of the liquid crystal capacitor (CLC) 155, which was changed by the parasitic capacitances (CDS), (CGS), can be compensated, thereby eliminating level shift (ΔV2) to disappear.

Such a storage capacitor line voltage (VH), which compensates for the level shift (ΔV2) to disappear, will be described in detail.

The voltage ΔV2 [V] of the level shift (ΔV2) is represented by the following equation:

$$\Delta V2=(CDS.dVX+Cs.dVH)/(CGS+CDS+CLC+Cs)$$

wherein dVH [V] is the amplitude of the storage capacitor line voltage (VH); dVX [V] is the amplitude of the image signal voltage (VX); Cs [F] is the capacity of the storage capacitor (Cs) 145; CLC [F] is the capacity of the liquid crystal capacitor (CLC) 155; and CGS [F] and CDS [F] are the values of the parasitic capacities (CGS) and (CDS), respectively.

In the present invention, the polarity of the storage capacitor line voltage (VH) is inverted with respect to a second standard potential (VT2) synchronize with the image signal voltage (VX) and to be opposite to that of the image signal voltage (VX). The amplitude (dVH) of the storage capacitor line voltage (VH) is |-CDS.dVX/Cs|. This storage capacitor line voltage (VH) is applied to the storage capacitor line 143 of the storage capacitor (Cs) 145 to let the level shift (ΔV2) represented by the above equation go to 0 (zero). Accordingly occurrence of flickers or nonuniformity of brightness is suppressed, thus obtaining a high quality display image.

Moreover, with respect to level shift (ΔV1) seen in FIGS. 12(*b*) and 12(*c*) which occurs in the liquid crystal applying voltage due to the parasitic capacitance (CGS) of the TFT element 127, a bias voltage, whose effective value compensates for level shift (ΔV1), is applied to the counter electrode 151. As a result, as shown in FIG. 4(*d*), the counter electrode potential (Vc) is deviated from the standard potential (VT1) of the image signal voltage (VX) to compensate for the level shift (ΔV1).

In the above embodiment, the amplitude (dVH) of the storage capacitor line voltage (VH) is set up at a value which precisely compensates the level shift (ΔV2), that is, |-CDS.dVX/Cs|. However, if the amplitude (dVH) is set up at |-CDS.dVX/Cs|/5 or more, advantageous effects sufficient for practical use can be obtained. Further, the amplitude (dVH) may be set up at |(-CDS.dVX/Cs)|×10 as a maximum, preferably |(-CDS.dVX/Cs)|×4 or less. In this range, advantageous effects sufficient to be visually recognized can be obtained. Thus, the amplitude (dVH) is not limited to |-CDS.dVX/Cs|.

As described above, a predetermined storage capacitor line voltage (VH) is applied to the storage capacitor line 143 so that the potential of the counter electrode 151, is changed in accordance with changes in the image signal voltage (VX) applied to the signal line 123 can be reduced, thus obtaining a high quality display image. Taking such potential changes of the counter electrode 151 into consideration, the amplitude (dVH) of the storage capacitor line voltage (VH) is preferably set up at a large value in the above range. Namely, the amplitude (dVH) is preferably |-CDS.dVX/Cs| or more.

Further, the second standard potential (VT2) is the same as the counter electrode potential (Vc). However, a voltage, which is applied to the addition circuit 503 and subtraction circuit 505 constituting the storage capacitor line voltage generating circuit 109, may be different from the direct current voltage (Vc) supplied from the counter electrode driving circuit 107. Thus, the second standard potential (VT2) may be different from the counter electrode potential (Vc).

A liquid crystal display device of the second embodiment will now be described below. The description regarding the same parts as those of the first embodiment is omitted for simplification. The parts different from those of the first embodiment will be described. The same parts as those of the first embodiment are denoted by the same reference number.

A counter electrode 151, as shown in FIG. 6(*c*), is connected to a counter electrode driving circuit 107, which generates a counter electrode voltage (Vc) whose polarity is inverted with respect to a second standard potential (VT2). to synchronize with an image signal voltage (VX).

Figure 7:
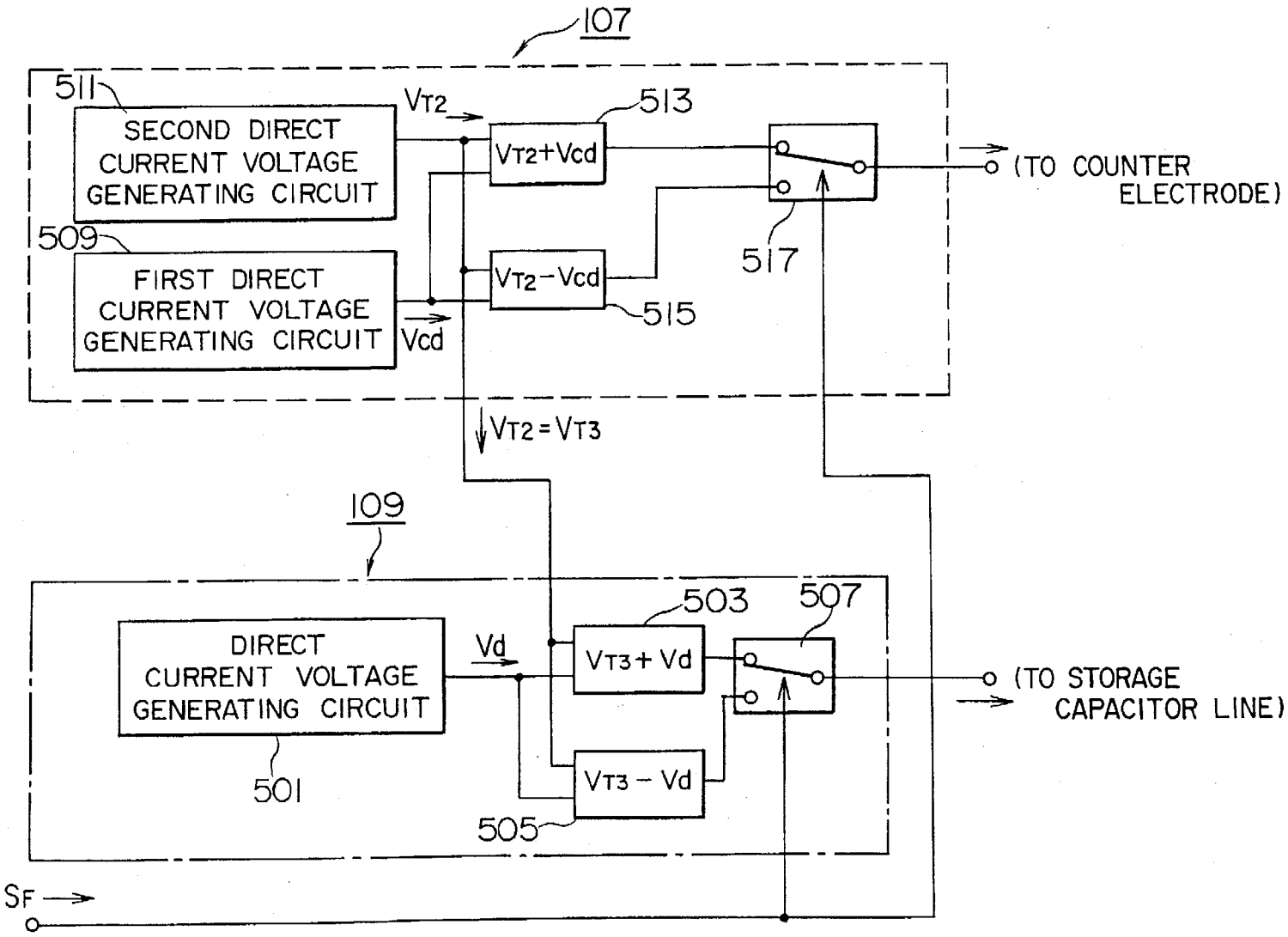
FIG. 7 is a view illustrating the structure of a storage capacitor line voltage generating circuit of an active matrix type liquid crystal display device according to the second embodiment of the present invention.

Referring to FIG. 7, the main part of the counter electrode driving circuit 107 is constructed of a first direct current voltage generating circuit 509, a second direct current generating circuit 511, an addition circuit 513, a subtraction circuit 515 and a switching circuit 517. The first direct current generating circuit 509 generates a voltage (Vcd) determining the amplitude of the counter electrode voltage (Vc). The second direct current voltage generating circuit 511 generates the second standard potential (VT2). The addition circuit 513 adds the second standard potential (VT2) supplied by the second direct current voltage generating circuit 511 to the voltage (Vcd) supplied by the first direct current voltage generating circuit 509, and outputs the sum. The subtraction circuit 515 subtracts the amplitude voltage (Vcd) supplied by the first direct current voltage generating circuit 509 from the second standard potential (VT2) supplied by the second direct current voltage generating circuit 511, and outputs the result. The switching circuit 517 selects the output from the addition circuit 513 or the output from the substraction circuit 515 on the basis of a frame signal (SF) every frame period (TF).

The main part of a storage capacitor line voltage generating circuit 109 is constructed to include a direct current voltage generating circuit 501 an addition circuit 503, a subtraction circuit 505 and a switching circuit 507. The second standard potential (VT2), which is supplied from the second direct current voltage generating circuit 511 of the counter electrode driving circuit 107, is used as a third standard potential (VT3). The addition circuit 503 adds the third standard potential (VT3) to a voltage (Vd) supplied by the direct current voltage generating circuit 501, and outputs the sum. The subtraction circuit 505 subtracts the voltage (Vd) supplied from the direct current voltage generating circuit 501 from the third standard potential (VT3), and outputs the result. The switching circuit 507 selects the output from the addition circuit 503 or the output from the substraction circuit 505 on the basis of a frame signal (SF) every frame period (TF).

As described above, inside the storage capacitor line voltage generating circuit 109, the third standard DC potential (VT3) of the direct current is subjected to the above addition or substraction using voltage (Vd). The addition or substraction is alternately selected to apply a storage capacitor line voltage (VH) with an amplitude (dVH) to a storage capacitor line 143.

At this time, the third standard potential (VT3) with the same potential as that of the second standard potential (VT2) supplied from the second direct current voltage generating circuit 511, and the voltage (Vd) supplied from the direct current voltage generating circuit 501 are set such that the amplitude (dVH) of the storage capacitor line voltage (VH) is |[(CGS+CDS+Cs).dVc-CDS.dVX]/Cs|.

In the liquid crystal display device of the second embodiment, the storage capacitor line voltage (VH) corresponding to a level shift (ΔV2) is applied to the storage capacitor line 143. As a result, the electric potential changes of liquid crystal capacitor (CLC) 155 caused by parasitic capacitances (CDS), (CGS) and of a storage capacitor (Cs) 145 are compensated to eliminate level shift (ΔV2).

The voltage ΔV2 [V] of the level shift (ΔV2) is represented by the following equation:

$$\Delta V2=\{CDS.dVX+Cs.dVH)-(CGS+CDS)dVC\}/(CGS+CDS+CLC+Cs)$$

wherein dVc [V] is the amplitude of the counter electrode voltage (Vc); dVH [V] is the amplitude of the storage capacitor line voltage (VH); dVX [V] is the amplitude of the image signal voltage (VX); Cs [F] is the capacity value of the storage capacitor (Cs) 145; CLC [F] is the capacity value of the liquid crystal capacitor (CLC) 155; and CGS [F] and CDS [F] are the capacity values of the parasitic capacities (CGS) and (CDS), respectively.

The polarity of the storage capacitor line voltage (VH) is inverted with respect to the third standard potential (VT3) to synchronize with the counter electrode voltage and to be the same as that of the counter electrode voltage (Vc) with respect to the second standard potential (VT2). The amplitude (dVH) of the storage capacitor line voltage (VH) is |[(CGS+CDS+Cs). dVc-CDS.dVX]/Cs|. Such a storage capacitor line voltage (VH) is applied to the storage capacitor line 143 to remove the level shift (ΔV2) represented by the above equation and suppress the occurrence of flickers and nonuniformity of brightness, thereby obtaining a high quality display image.

Further, in this embodiment, with respect to a level shift (ΔV1) which occurs due to the parasitic capacitance (CGS) of TFT element 127, a bias voltage, whose effective value compensates the level shift (ΔV1), is added to the counter electrode voltage (Vc) which is applied to the counter electrode 151. In other words, as shown in FIG. 4(*d*), the standard potential (VT2) of the counter electrode potential (Vc) is shifted to the standard potential (VT1) of the image signal voltage (VX) to remove the level shift (ΔV1).

In the above embodiment, the amplitude (dVH) of the storage capacitor line voltage (VH) is set up at the best value which most effectively compensates the level shift (ΔV2), i.e., |[(CGS+CDS+Cs).dVc-CDS.dVX/Cs|. However, if the amplitude (dVH) is set up at |[(CGS+CDS+Cs).dVc-CDS.dVX/Cs |/5 or more, advantageous effects sufficient for practical use can be obtained. If the maximum of the amplitude (dVH) is |[(CGS+CDS+Cs).dVc-CDS.dVX]/Cs|× 10 or less, preferably |[(CGS+CDS+Cs).dVc-CDS.dVX]/Cs|×4 or less, advantageous effects sufficient to be visually recognized can be obtained. Thus, it is not necessary that the amplitude (dVH) is limited to the above best value.

Further, for the purpose of reducing potential changes on the counter electrode 151, the amplitude (dVH) of the storage capacitor line voltage (VH) is preferably set up at a large value within the above range. The amplitude (dVH) is preferably |[(CGS+CDS+Cs).dVc-CDS.dVX]/Cs| or more.

The counter electrode driving circuit 107 generates the counter electrode voltage (Vc) with the amplitude dVc, whose polarity is inverted with respect to the second standard potential (VT2) every frame period as one period, and supplies it to the counter electrode 151.

Figure 9:
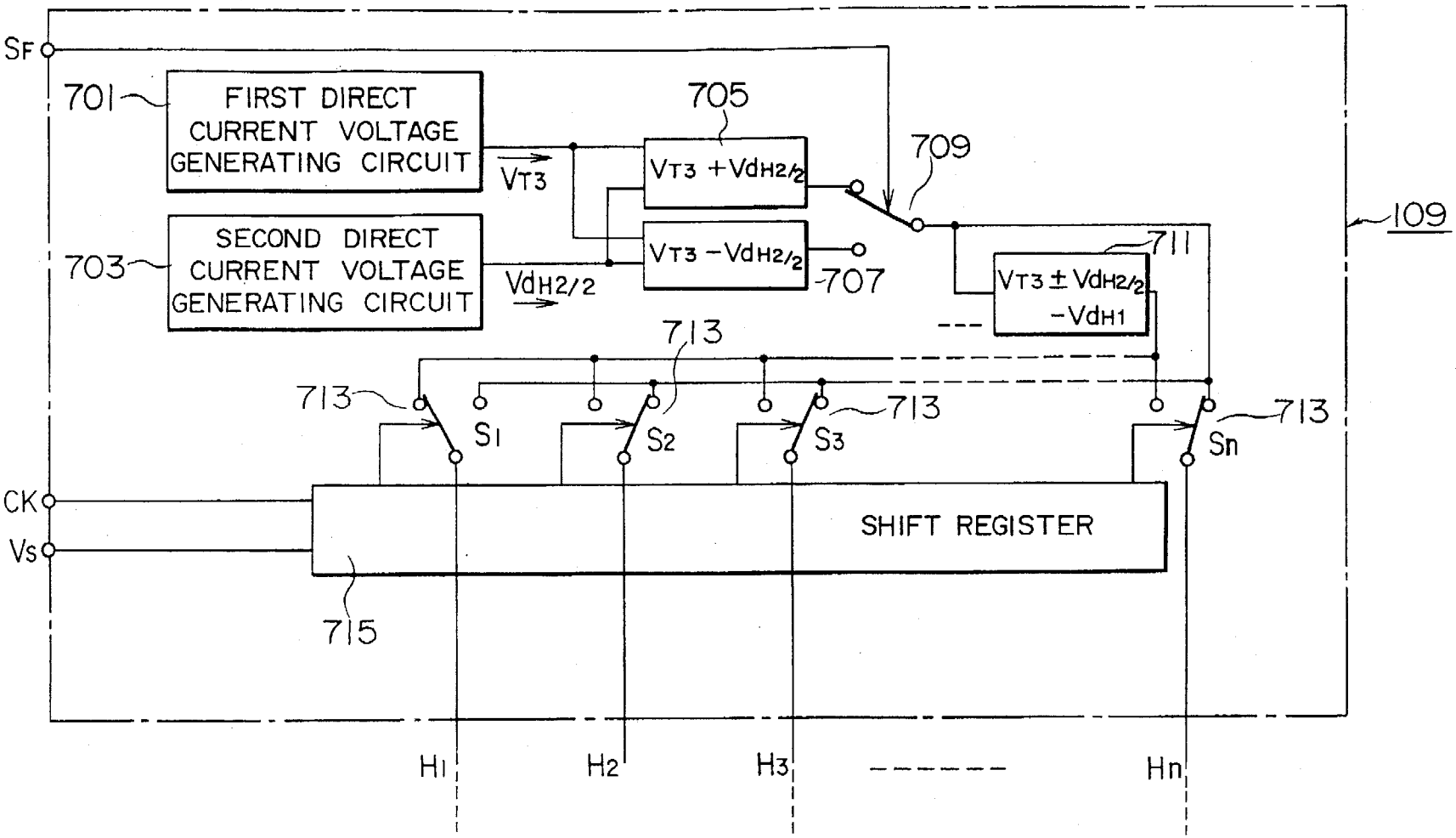
FIG. 9 is a view illustrating the structure of a storage capacitor line driving circuit of an active matrix type liquid crystal display device according to the third embodiment of the present invention.
Figure 10:
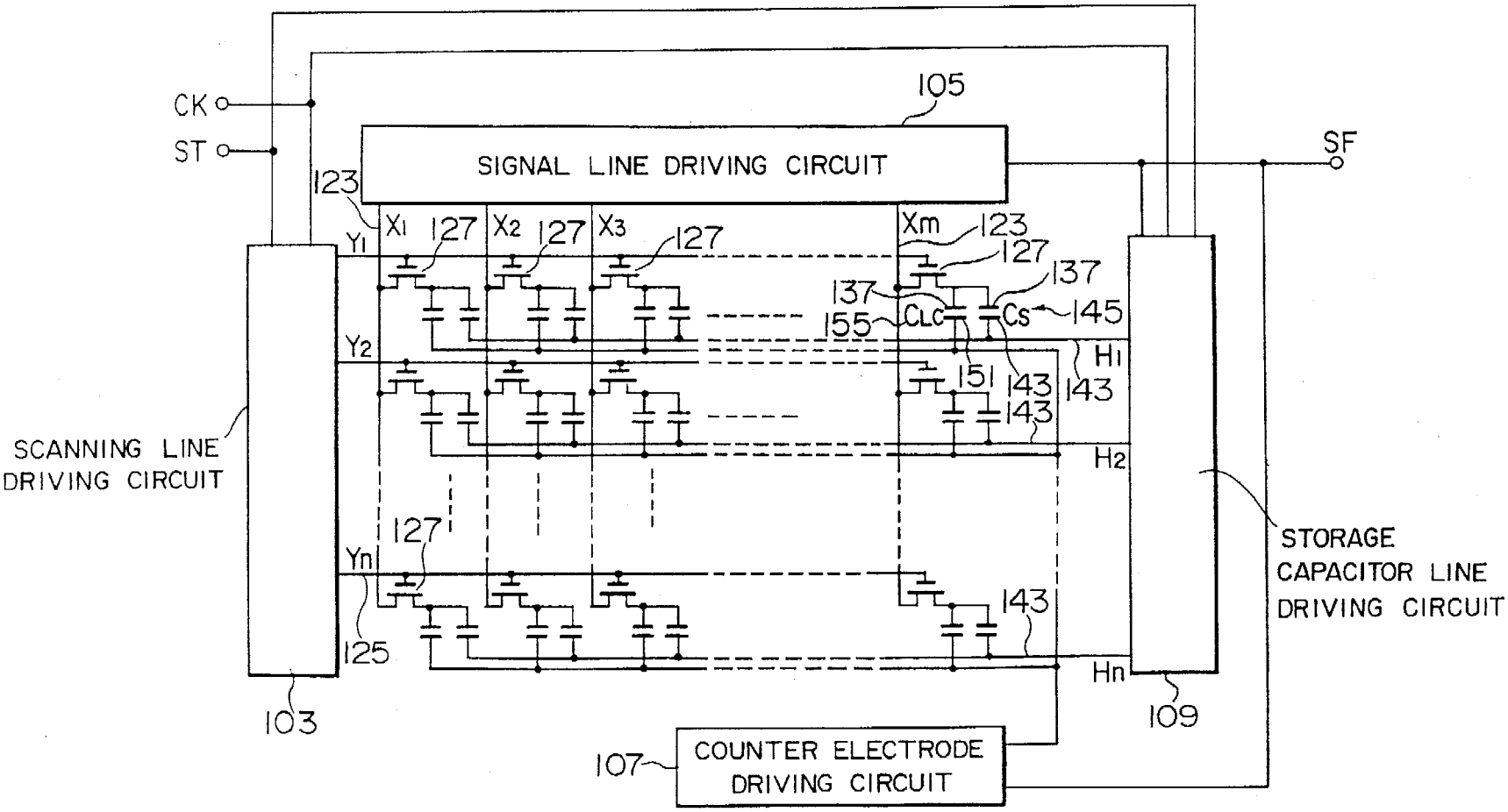
FIG. 10 is a view illustrating the structure of an active matrix type liquid crystal display device according to the third embodiment of the present invention.
Figure 11:
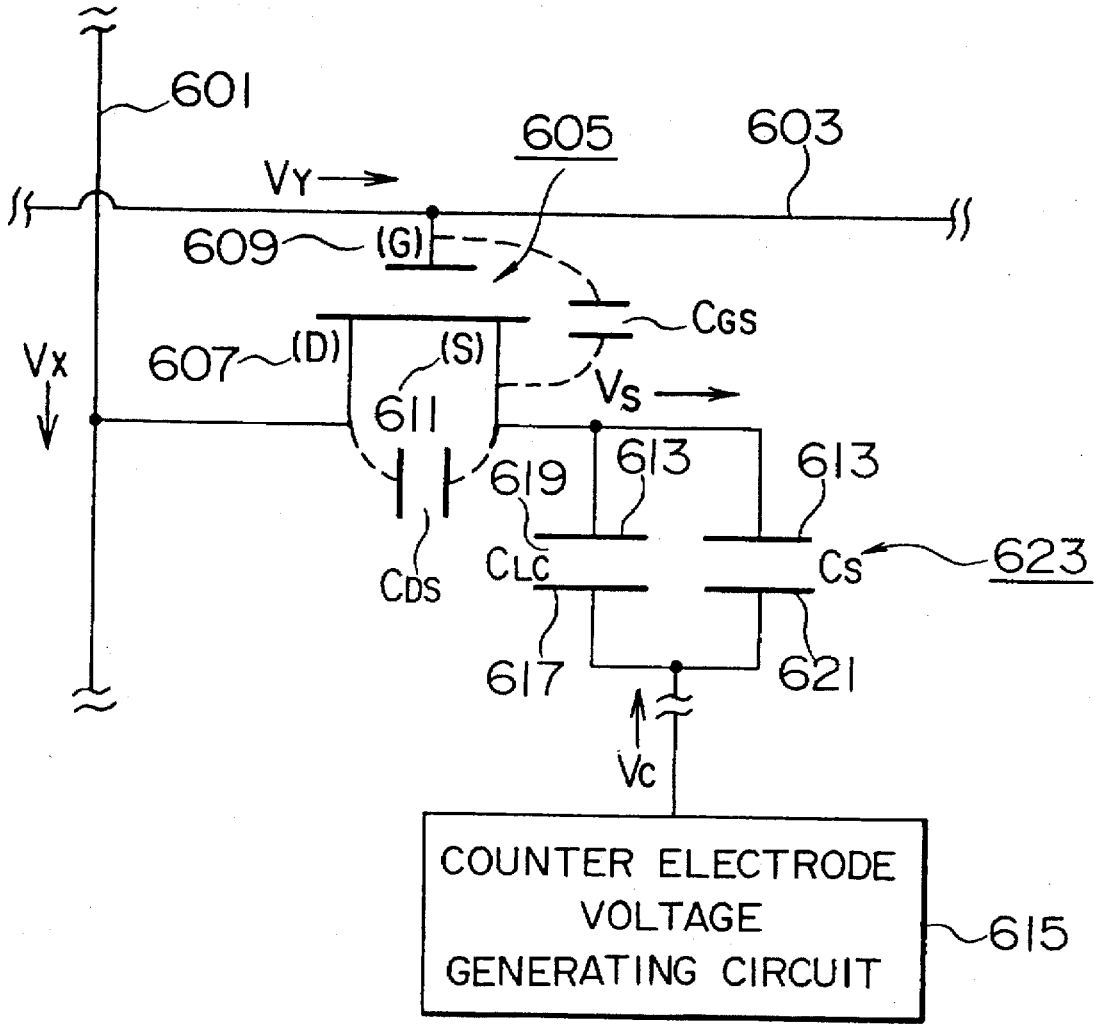
FIG. 11 (PRIOR ART)
FIG. 11 is a view illustrating an equivalent circuit showing the structure of a conventional liquid crystal display device.

As shown in FIGS. 9 and 10, a main part of storage capacitor line driving circuit 109 is constructed to include a first direct current voltage generating circuit 701, a second direct current voltage generating circuit 703, an addition circuit 705, a subtraction circuit 707, a first switching circuit 709, a second subtraction circuit 711, a second switching circuit 713, and a shift register 715. The first direct current voltage generating circuit 701 generates a third standard potential (VT3). The second direct current voltage generating circuit 703 generates a voltage (VdH2/2). The addition circuit 705 adds the third standard potential (VT3) to the voltage (VdH2/2). The subtraction circuit 707 subtracts the voltage (VdH2/2) from the third standard potential (VT3). The first switching circuit 709 selects the output from the addition circuit 705 or the output from the subtraction circuit 707 on the basis of a frame signal (SF) every frame period (TF). The second subtraction circuit 711 subtracts a voltage (VdH1), which determines a voltage change (dVH1) in the direction opposite to the scanning pulse, from the output selected by the switching circuit 709. The second switching circuit 713 selects either the output directly from the first switching circuit 709 or the output via the second subtraction circuit 711. The shift register 715 controls the second switching circuit 713 on the basis of a clock pulse (CK) and start signal (ST), which are similar to those inputted to a scanning line driving circuit 103.

The storage capacitor line driving circuit 109 selects the added output of the voltage (VdH2) and the direct current third standard potential (VT3), or the subtracted output of the voltage (VdH2) and the third standard potential (VT3), alternately. As a result, as shown in FIG. 8(*d*), the storage capacitor line voltage (VH) with the amplitude (dVH2) is applied to a storage capacitor line 143. The voltage (VdH1) is subtracted from the output from the second switching circuit 713 on the basis of the clock pulse (CK) and start signal (ST) so that, as shown in FIG. 8(*d*), the storage capacitor line voltage (VH) is changed in the direction opposite to the scanning pulse by a voltage change (dVH1). The resultant storage capacitor line voltage (VH) is applied to the storage capacitor line 143.

In the liquid crystal display device of the present invention, the storage capacitor line voltage (VH) has the voltage change (dVH1) and the voltage amplitude (dVH2) which suppress the level shifts (ΔV1), (ΔV2), respectively. This storage capacitor line voltage (VH) is applied to each storage capacitor line 143. For example, a storage capacitor line voltage (VHj), which is synchronized with a timing where a scanning pulse is applied to the j-th scanning line 125, is applied to the j-th storage capacitor line 143. As a result, this compensates for electric potential differences of liquid crystal capacitor (CLC) 155 caused by parasitic capacitances (CGS), (CDS), to remove the level shifts (ΔV1), (ΔV2).

Such a storage capacitor line voltage (VH), which removes the level shifts (ΔV1), (ΔV2), will be described in detail.

The voltages ΔV1 [V], ΔV2 [V] of the level shifts (ΔV1), (ΔV2) are represented by the following equations:

$$\Delta V1=(CGS.dVY+Cs.dVH)/(CGS+CDS+CLC+Cs)$$

$$\Delta V2=\{CDS.[VX_{(TF1)}-VX_{(TF2)}]+Cs.dVH2-(CGS+CDS)[Vc_{(TF1)}-Vc_{(TF2)}]\}/(CGS+CDS+CLC+Cs)$$

wherein dVY [V] is the amplitude of the scanning pulse (VY); dVH1 [V] is the voltage change of the storage capacitor line voltage; dVH2 [V] is the voltage amplitude; $VX_{(TF1)}$ [V] is the image signal voltage (VX) for a frame period (TF1); $Vc_{(TF1)}$ [V] is the counter electrode voltage (Vc); $VX_{(TF2)}$ [V] is the image signal voltage (VX) for next frame period (TF2) after the frame period (TF1); $Vc_{(TF2)}$ [V] is the counter electrode voltage (Vc); Cs [F] is the capacity value of the storage capacitor (Cs) 145; CLC [F] is the capacity value of the liquid crystal capacitor (CLC) 155; and CGS [F] and CDS [F] are the capacity values of the parasitic capacities (CGS) and (CDS), respectively.

In the liquid crystal display device of the present invention, the polarity of a storage capacitor line voltage (VHj) is inverted with respect to the third standard potential to synchronize with a counter electrode voltage (Vc) and to be the same as that of the counter electrode voltage (Vc). The storage capacitor line voltage (VHj) is controlled such that the amplitude (dVH2) thereof is $dVH2=|[CGS+CDS+Cs)(Vc_{(TF1)}-Vc_{(TF2)})\ -CDS(VX_{(TF1)}-VX_{(TF2)}))]/Cs|$. The voltage of the storage capacitor line voltage (VHj) is controlled to be changed in the direction opposite to the scanning pulse and to be synchronized with a scanning pulse (VYj) by a changed amount, dVH1=|-CGS.dVY/Cs|. Such a storage capacitor line voltage (VHj) is applied to the j-th storage capacitor line 143 while synchronizing with the timing of the scanning pulse (VYj). The j-th storage capacitor line 143 corresponds to a pixel electrode 137 connected to a TFT element 127, to which the scanning pulse (VYj) via the j-th scanning line 125 is applied. As a result, the level shifts (ΔV1), (ΔV2) can be most effectively suppressed.

Since the value $(VX_{(TF1)}-VX_{(TF2)})$ changes with each image display, the middle voltage between the maximum and minimum values of the image signal voltage (VX) is actually used in this embodiment.

In this embodiment, the amplitude (dVH2) of the storage capacitor line voltage (VH) is set up at the value which can most effectively suppress level shift (ΔV2). However, the amplitude (dVH2) is not limited to this value. If the amplitude (dVH2) is set up at $|[CGS+CDS+Cs)(Vc_{(TF1)}-Vc_{(TF2)}) -CDS (VX_{(TF1)}-VX_{(TF2)})]/Cs|/5$ or more, advantageous effects for practical use can be obtained. If the maximum thereof is $|[CGS+CDS+Cs)(Vc_{(TF1)}-Vc_{(TF2)}) -CDS(VX_{(TF1)}-VX_{(TF2)})]Cs|\times 10$, preferably $|[CGS+CDS+Cs)(Vc_{(TF1)}-Vc_{(TF2)})-CDS(VX_{(TF1)}-VX_{(TF2)})]Cs|\times 4$, advantageous effects which is visually recognized can be obtained.

In the case of applying a counter electrode voltage (Vc) whose polarity is periodically inverted with respect to the second standard potential, distortion may occur in the counter electrode voltage (Vc) depending upon the value of the liquid crystal capacitor (CLC) at the time of polarity inversion. This may cause nonuniformity of brightness in the directions of the signal line and the scanning line. However, the determined storage capacitor line voltage (VH) is applied to the storage capacitor 145 to reduce potential changes of a counter electrode 151 accompanied with changes of image signal voltage (VX) applied to a signal line 123. As a result, a high quality display image can be obtained. Taking such potential change reduction of the counter electrode 151 into consideration, the amplitude (dVH2) of the storage capacitor line voltage (VH) is preferably set up at a large value in the above range. The value is preferably $|[CGS+CDS+Cs)(Vc_{(TF1)}-Vc_{(TF2)})-CDS(VX_{(TF1)}-VX_{(TF2)})]/Cs|$ or more.

In the above embodiments, the case, where the image signal voltage (VX) is inverted with respect to the standard potential every frame period (TF), is exemplified. However, even in the case where the image signal voltage (VX) is inverted every one scanning line, or a plurality of scanning lines, a storage capacitor line voltage (VH), which compensates for level shift (ΔV2), is applied to the storage capacitor line 143, thereby obtaining similar advantageous effects.

In the above embodiments, although the second standard potential (VT2) is set up at the same potential as the third standard potential (VT3), the second and third standard potentials may be set up at different values.

Further, in the above embodiments, although the first standard potential (VT1) is set up at a potential different from that of the second standard potential (VT2), they may be set up at the same potential. However, in this case, suppression of ΔV1 by an off-set voltage is lost. Thus, if ΔV1 is small enough not to disturb the practical use of an image display, it can be ignored. Alternatively, another means can be used for removing ΔV1.

In the above embodiments, the polarity of the image signal voltage (VX) is inverted with respect to a single standard potential (VT1). However, the technique of the present invention can be applied to the case of setting a plurality of standard potentials of the image signal voltage (VX), such as multi-gradation display.

Obviously, numerous other modifications, for example modification of a TFT material or structure, are possible within the scope of the appended claims.

What is claimed is:

1. A liquid crystal display device comprising:

matrix wiring having a plurality of scanning lines and a plurality of signal lines disposed to intersect with the plurality of scanning lines, wherein a scanning pulse is applied to the scanning lines, and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a storage capacitor formed between the pixel electrode and a storage capacitor line;

a counter electrode disposed opposite to the pixel electrode;

a liquid crystal composition held between the pixel electrode and the counter electrode; and means for supplying a storage capacitor line voltage to the storage capacitor line, wherein the storage capacitor line voltage, the polarity of which is inverted with respect to a second standard potential white substantially synchronized with the polarity inversion of the image signal voltage, is applied to the storage capacitor line so as to compensate for a change of a liquid crystal applying voltage substantially synchronized with the polarity inversion of the image signal voltage in each frame period.

2. The liquid crystal display device of claim 1, further comprising counter electrode driving means for supplying a direct current voltage to the counter electrode.

3. A liquid crystal display device, comprising:

matrix wiring having a plurality of scanning lines and a plurality of signal lines disposed to intersect with the plurality of scanning lines, wherein a scanning pulse is applied to the scanning lines, and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a storage capacitor formed between the pixel electrode and a storage capacitor line;

a counter electrode disposed opposite to the pixel electrode;

a liquid crystal composition held between the pixel electrode and the counter electrode;

means for supplying a storage capacitor line voltage to the storage capacitor line; and counter electrode driving means for applying a direct current voltage to the counter electrode, wherein the storage capacitor line voltage, the polarity of which is inverted with respect to a second standard potential while substantially synchronized with the polarity inversion of the image signal voltage, is applied to the storage capacitor line so as to compensate for a change of a liquid crystal applying voltage substantially synchronized with the polarity inversion of the image signal voltage, and wherein an amplitude of the storage capacitor line voltage, substantially synchronized with the image signal voltage, is in the range of $|-CDS \times dVX/Cs|/5$ to $|-CDS \times dVX/Cs| \times 10$, wherein CDS is a parasitic capacitance associated with a drain electrode of the transistor switching element and a source electrode of the transistor switching element, dVX is an amplitude of the image signal voltage, and Cs is a capacitance of the storage capacitor.

4. The liquid crystal display device of claim 3, wherein the amplitude of the storage capacitor line voltage, substantially synchronized with the image signal voltage, is $|-CDS \times dVX/Cs|$.

5. The liquid crystal display device of claim 1, wherein the counter electrode is connected to counter electrode voltage driving means for supplying a counter electrode voltage having a counter voltage polarity inverted with respect to a third standard potential while synchronized with the image signal voltage and having a polarity inverted with respect to the third standard potential whose polarity is the same as that of the storage capacitor line voltage inverted with respect to the second standard potential.

6. The liquid crystal display device of claim 5, wherein the amplitude of the storage capacitor line voltage is larger than that of the counter electrode voltage.

7. A liquid crystal display device comprising:

matrix wiring having a plurality of scanning lines and a plurality of signal lines disposed to intersect with the plurality of scanning lines, wherein a scanning pulse is applied to the scanning lines, and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a storage capacitor formed between the pixel electrode and a storage capacitor line;

a counter electrode disposed opposite to the pixel electrode;

a liquid crystal composition held between the pixel electrode and the counter electrode; and means for supplying a storage capacitor line voltage to the storage capacitor line, wherein the storage capacitor line voltage, the polarity which is inverted with respect to a second standard potential while substantially synchronized with the polarity inversion of the image signal voltage, is applied to the storage capacitor line so as to compensate for a change of a liquid crystal applying voltage substantially synchronized with the polarity inversion of the image signal voltage, and wherein the amplitude of the storage capacitor line voltage is in the range of $|\{(CGS+CDS+Cs)dVc-CDS \times dvX\}/Cs|/5$ to $|\{(CGS+CDS+Cs)dVc-CDS \times dVX\}/Cs| \times 10$, wherein CGS is a parasitic capacitance associated with a gate electrode and a source electrode of the transistor switching element, CDS is a parasitic capacitance associated with a drain electrode and the source electrode of the transistor switching element, dVc is an amplitude of the counter electrode voltage applied to the counter electrode, dVX is an amplitude of the image signal voltage, and Cs is a capacitance of the storage capacitor.

8. The liquid crystal display device of claim 7, wherein the amplitude of the storage capacitor line voltage is $|\{(CGS+CDS+Cs)dVc-CDS \times dVX\}/Cs|$.

9. A liquid crystal display device comprising:

matrix wiring having a plurality of scanning lines and a plurality of signal lines disposed to intersect with the plurality of scanning lines, wherein a scanning pulse is applied to the scanning lines, and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode;

a liquid crystal composition held between the pixel electrode and the counter electrode;

a storage capacitor formed between the pixel electrode and a storage capacitor line disposed substantially in parallel with the scanning line; and storage capacitor line driving means for supplying a storage capacitor line voltage to the storage capacitor line, wherein a potential level of the storage capacitor line voltage is changed substantially synchronizing with the scanning pulse, a direction of the potential level change of the storage capacitor line voltage is opposite to a direction of a potential level change of the scanning pulse, so as to compensate for a change of liquid crystal applying voltage substantially synchronizing with the scanning pulse.

10. The liquid crystal display device of claim 9, further comprising counter electrode driving means for supplying a direct current voltage to the counter electrode, the counter electrode driving means being connected to the counter electrode.

11. The liquid crystal display device of claim 10, wherein a change of the storage capacitor line voltage, substantially synchronizing with the scanning pulse, is in the range of $|(-CGS \times dVY)/Cs|/2$ to $|(-CGS \times dVY)/Cs| \times 2$, wherein CGS is a parasitic capacitance associated with a gate electrode and a source electrode of the transistor switching element, dVY is an amplitude of the scanning pulse and Cs is a capacitance of the storage capacitor.

12. The liquid crystal display device of claim 11, wherein the potential change of the storage capacitor line voltage is $|(-CGS \times dVY)/Cs|$.

13. The liquid crystal display device of claim 9, further comprising counter electrode voltage driving means for applying a counter electrode voltage, having a counter electrode voltage polarity inverted with respect to a second standard potential while substantially synchronized with the image signal voltage, to the counter electrode.

14. The liquid crystal display device of claim 13, wherein a change of the storage capacitor line voltage substantially synchronized with the scanning pulse is in the range of $|(-CGS \times dVY)/Cs|/2$ to $|(-CGS \times dVY)/Cs| \times 2$, wherein CGS is a parasitic capacitance between a gate electrode and a source electrode of the transistor switching element, dVY is an amplitude of the scanning pulse and Cs is a capacitance of the storage capacitor.

15. The liquid crystal display device of claim 14, wherein the change of the storage capacitor line voltage, substantially synchronized with the scanning pulse, is $|(-CGS \times dVY)/Cs|$.

16. A liquid crystal display device comprising:

matrix wiring having a plurality of scanning lines and a plurality of signal lines disposed to intersect with the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a direct current voltage is applied to the counter electrode;

a liquid crystal composition held between the pixel electrode and the counter electrode;

a storage capacitor formed between the pixel electrode and a storage capacitor line; and storage capacitor line voltage driving means for supplying a storage capacitor line voltage to the storage capacitor line, wherein the polarity of the storage capacitor line voltage is inverted with respect to a second standard potential while synchronized with the polarity inversion of the image signal voltage so as to compensate for a first change of a liquid crystal applying voltage substantially synchronized with the polarity inversion of the image signal voltage in each frame period, and wherein the potential of the storage capacitor line voltage changes while substantially synchronized with the scanning pulse so as to compensate for a second change of a liquid crystal applying voltage substantially synchronized with the scanning pulse in each frame period.

17. A liquid crystal display device, comprising:

matrix wiring having a plurality of scanning lines and a plurality of signal lines disposed to intersect with the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a direct current voltage is applied to the counter electrode;

a liquid crystal composition held between the pixel electrode and the counter electrode;

a storage capacitor formed between the pixel electrode and a storage capacitor line; and storage capacitor line voltage driving means for supplying a storage capacitor line voltage to the storage capacitor line, wherein the polarity of the storage capacitor line voltage is inverted with respect to a second standard potential while synchronized with the polarity inversion of the image signal voltage so as to compensate for a first change of a liquid crystal applying voltage substantially synchronized with the polarity inversion of the image signal voltage, and wherein the potential of the storage capacitor line voltage changes while substantially synchronized with the scanning pulse so as to compensate for a second change of a liquid crystal applying voltage substantially synchronized with the scanning pulse, and wherein a change of the storage capacitor line voltage, substantially synchronized with the scanning pulse, is in the range of $|(-CGS \times dVY)/Cs|/2$ to $|(-CGS \times dVY)/Cs| \times 2$, wherein CGS is a parasitic capacitance associated with a gate electrode and a source electrode of the transistor switching element, dVY is an amplitude of the scanning pulse and Cs is a capacitance of the storage capacitor.

18. The liquid crystal display device of claim 17, wherein the change of the storage capacitor line voltage, substantially synchronizing with the scanning pulse, is $|(-CGS \times dVY)/Cs|$.

19. A liquid crystal display device comprising:

matrix wiring having a plurality of scanning lines and a plurality of signal lines disposed to intersect with the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a direct current voltage is applied to the counter electrode;

a liquid crystal composition held between the pixel electrode and the counter electrode;

a storage capacitor formed between the pixel electrode and a storage capacitor line; and storage capacitor line voltage driving means for supplying a storage capacitor line voltage to the storage capacitor line, wherein the polarity of the storage capacitor line voltage is inverted with respect to a second standard potential while synchronized with the polarity inversion of the image signal voltage so as to compensate for a first change of a liquid crystal applying voltage substantially synchronized with the polarity inversion of the image signal voltage, and wherein the potential of the storage capacitor line voltage changes while substantially synchronized with the scanning pulse so as to compensate for a second change of a liquid crystal applying voltage substantially synchronized with the scanning pulse, and wherein the change of the storage capacitor line voltage, substantially synchronizing with the image signal voltage, is in the range of |-CDS{VX(TF1)–VX(TF2)}/Cs|/5 to |-CDS{VX(TF1)–VX(TF2)}/Cs|×5 wherein CDS is a parasitic capacitance associated with a drain electrode and a source electrode of the transistor switching element, VX(TF1) is an image signal voltage for one period (TF1), VX(TF2) is an image signal voltage for a next period (TF2) and Cs is a capacitance of the storage capacitor.

20. The liquid crystal display device of claim 19, wherein the potential change of the storage capacitor line voltage, substantially synchronized with the image signal voltage, is |-CDS{VX(TF1)–VX(TF2)}/Cs|.

21. A liquid crystal display device comprising:

matrix wiring having a plurality of scanning lines and a plurality of signal lines disposed to intersect the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a counter electrode voltage, having a counter voltage polarity inverted with respect to a second standard potential while synchronized with the image signal voltage, is applied to the counter electrode;

a liquid crystal composition held between the pixel electrode and the counter electrode;

a storage capacitor line and a storage capacitor formed between the pixel electrode and the storage capacitor line disposed in parallel with the scanning lines; and storage capacitor voltage driving means for supplying a storage capacitor line voltage to the storage capacitor line, wherein the polarity of the storage capacitor line voltage is inverted with respect to a third standard potential in the same direction as the polarity of the counter electrode voltage while synchronizing with the counter electrode voltage, so as to compensate for a first change of a liquid crystal applying voltage substantially synchronized with the image signal voltage, and wherein the potential of the storage capacitor line voltage changes while substantially synchronized with the scanning pulse so as to compensate for a second change of a liquid crystal applying voltage substantially synchronized with the scanning pulse in each frame period.

22. A liquid crystal display device, comprising:

matrix wiring having a plurality of scanning lines and a plurality of signal lines disposed to intersect the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a counter electrode voltage, having a counter voltage polarity inverted with respect to a second standard potential while synchronized with the image signal voltage, is applied to the counter electrode;

a liquid crystal composition held between the pixel electrode and the counter electrode;

a storage capacitor line and a storage capacitor formed between the pixel electrode and the storage capacitor line disposed in parallel with the scanning lines; and storage capacitor voltage driving means for supplying a storage capacitor line voltage to the storage capacitor line, wherein the polarity of the storage capacitor line voltage is inverted with respect to a third standard potential in the same direction as the polarity of the counter electrode voltage while synchronizing with the counter electrode voltage, so as to compensate for a first change of a liquid crystal applying voltage substantially synchronized with the image signal voltage, and wherein the potential of the storage capacitor line voltage changes while substantially synchronized with the scanning pulse so as to compensate for a second change of a liquid crystal applying voltage substantially synchronized with the scanning pulse, and wherein a change of the storage capacitor line voltage, substantially synchronizing with the scanning pulse, is in the range of |(-CGS×dVY)/Cs|/2 to |(-CGS×dVY)/Cs|×2, wherein CGS is a parasitic capacitance associated with a gate electrode and a source electrode of the transistor switching element, dVY is an amplitude of the scanning pulse and Cs is a capacitance of the storage capacitor.

23. The liquid crystal display device of claim 22, wherein the change of the storage capacitor line voltage, substantially synchronizing with the scanning pulse, is |(-CGS×dVY)/Cs|.

24. A liquid crystal display device, comprising:

matrix wiring having a plurality of scanning lines and a plurality of signal lines disposed to intersect the plurality of scanning lines, wherein a scanning pulse is applied to the scanning lines and an image signal voltage, having a polarity periodically inverted with respect to a first standard potential, is applied to the signal lines;

a pixel electrode disposed at each intersection of the plurality of scanning lines and the plurality of signal lines;

a transistor switching element included at each intersection of the plurality of scanning lines and the plurality of signal lines and connected to each pixel electrode;

a counter electrode disposed opposite to the pixel electrode, wherein a counter electrode voltage, having a counter voltage polarity inverted with respect to a second standard potential while synchronized with the image signal voltage, is applied to the counter electrode;

a liquid crystal composition held between the pixel electrode and the counter electrode;

a storage capacitor line and a storage capacitor formed between the pixel electrode and the storage capacitor line disposed in parallel with the scanning lines; and storage capacitor voltage driving means for supplying a storage capacitor line voltage to the storage capacitor line, wherein the polarity of the storage capacitor line voltage is inverted with respect to a third standard potential in the same direction as the polarity of the counter electrode voltage while synchronizing with the counter electrode voltage, so as to compensate for a first change of a liquid crystal applying voltage substantially synchronized with the image signal voltage, and wherein the potential of the storage capacitor line voltage changes while substantially synchronized with the scanning pulse so as to compensate for a second change of a liquid crystal applying voltage substantially synchronized with the scanning pulse, and wherein a change of the storage capacitor line voltage, substantially synchronized with the polarity inversion of the image signal voltage, is in the range of $|(CGS+CDS+Cs)\{VX(TF1)-VX(TF2)\}-CDS\{VX(TF1)-VX(TF2)\}/Cs|/5$ to $|(CGS+CDS+Cs)\{VC(TF1)-VC(TF2)\}-CDS\{VX(TF1)-VX(TF2)\}/Cs|\times 10$, wherein CGS is a parasitic capacitance associated with a gate electrode and a source electrode of the transistor switching element, CDS is a parasitic capacitance associated with a drain electrode and a source electrode of the transistor switching element, Cs is a capacitance of the storage capacitor, VC(TF1) is a counter electrode voltage for one period (TF1), VC(TF2) is a counter electrode voltage for a next period (TF2), VX(TF1) is an image signal voltage for one period (TF1), and VX(TF2) is an image signal voltage for a next period (TF2).

25. The liquid crystal display device of claim 24, wherein the change of the storage capacitor line voltage, substantially synchronized with the polarity inversion of the image signal voltage, is $|(CGS+CDS+Cs)\{VC(TF1)-VC(TF2)\}-CDS\{VX(TF1)-VX(TF2)\}/Cs|$.

* * * * *

UNITED STATES PATENT AND TRADEMARK OFFICE

CERTIFICATE OF CORRECTION

PATENT NO. : 5,686,932

DATED : November 11, 1997

INVENTOR(S) : Satoru TOMITA

It is certified that error appears in the above-identified patent and that said Letters Patent is hereby corrected as shown below:

Claim 1, column 14, line 32, "white" should read --while--.

Signed and Sealed this

Twenty-eighth Day of July, 1998

Bruce Lehman

*Attest:*

BRUCE LEHMAN

*Attesting Officer*

*Commissioner of Patents and Trademarks*